United States Patent [19]

Howerton

[11] 4,225,978

[45] Oct. 7, 1980

[54] COMBINATION CAPE AND UTILITY BAG

[76] Inventor: Larry L. Howerton, 2607 McKinney St., Boise, Id. 83704

[21] Appl. No.: 19,289

[22] Filed: Mar. 12, 1979

[51] Int. Cl.[2] ..... A41D 3/08

[52] U.S. Cl. ..... 2/88

[58] Field of Search ..... 2/88, 93, 84, 94, 87, 2/85; 150/1

[56] References Cited

U.S. PATENT DOCUMENTS

| | | | |
|---|---|---|---|
| 1,702,143 | 2/1929 | Weisz | 2/84 |
| 2,462,269 | 2/1949 | Krempel | 2/84 |
| 2,971,198 | 2/1961 | Tomich | 2/84 |
| 3,522,612 | 8/1970 | Palmer | 2/84 |
| 4,078,264 | 3/1978 | DeGennaro | 2/88 |

*Primary Examiner*—Doris L. Troutman

*Attorney, Agent, or Firm*—Paul F. Horton

[57] ABSTRACT

A cape having a back panel and two front panels. The cape is provided with interior zippers and handle members. The cape, when reversed and folded, may be zipped together to form a utility bag for carrying sporting equipment. The cape may be provided with pockets and a hood as well as an insulative liner.

10 Claims, 8 Drawing Figures

COMBINATION CAPE AND UTILITY BAG

BACKGROUND OF THE INVENTION

1. Field of the Invention

The present invention relates in general to capes, and more particularly, to capes which are convertible into utility bags.

2. Description of the Prior Art

It is common for athletes, and particularly football players, to carry and be responsible for their own equipment when traveling. For the football player, this equipment usually includes a weather protective cape, helmet, shoulder pads, pants, shoes, etc., requiring a bag of large size. Any means of reducing bag size and weight of articles carried is therefore highly desireable.

There have been several approaches to the size and weight problem in the past as best exemplified by U.S. Pat. No. 1,643,440 issued to M. Baldwin and U.S. Pat. No. 3,818,158 issued to T. Nakanishi. While such devices are useful for their intended purpose, such devices are not at all suitable for football gear. If increased in size, such devices would present capes of exorbitant size.

SUMMARY OF THE INVENTION

The present invention comprises a cape having interiorly placed zippers and handles which, when the cape is reversed and folded, may combine to form a large utility bag. A more complete description of the invention may be found in the appended claims.

It is therefore a primary object of the present invention to provide a simple cape which, through the use of zippers, is readily converted to a large utility bag.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
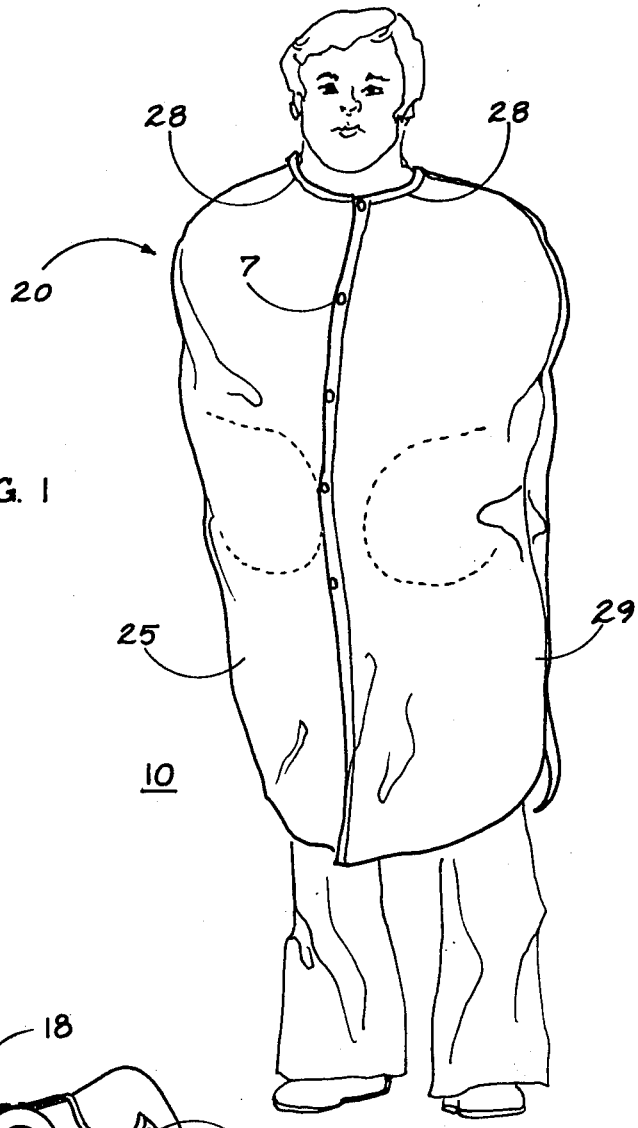
FIG. 1 is a perspective view illustrating the invention in use as a cape.
Figure 2:
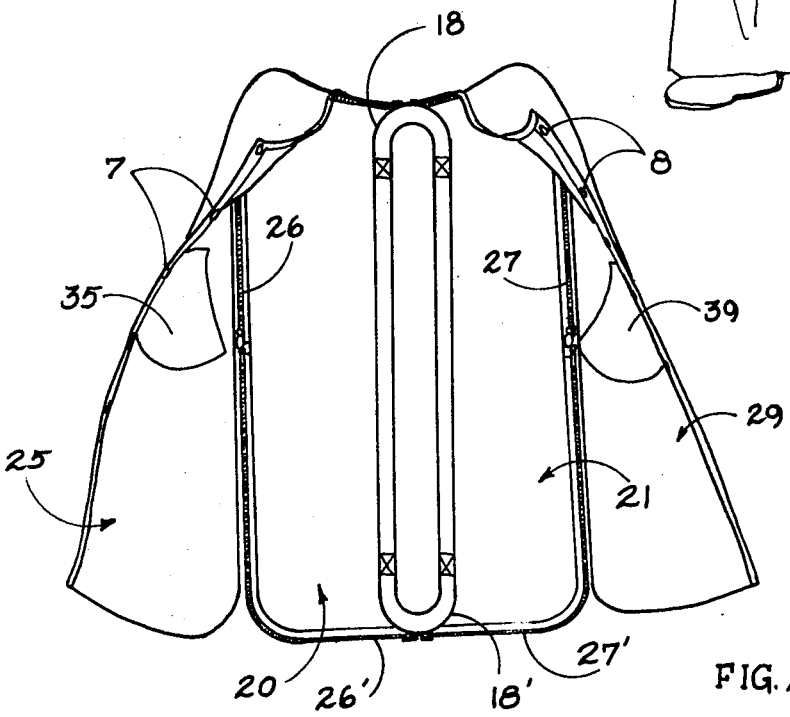
FIG. 2 is a front perspective view with front cape portions open to show interior zippers, handles and pocket locations.

Referring now to the drawings, and more particularly to FIGS. 1 and 2, one embodiment to be preferred of the cape-bag combination 10 of the present invention is disclosed. Combination 10 includes a back panel 20, a pair of front panels 25 and 29, a pair of releaseable fastening members, zipper portions 26 and 27, and a pair of cooperating fasteners, zipper portions 26' and 27'.

Back panel 20, in one embodiment, includes a single sheet of flexible, water-repellant material such as vinyl which is substantially rectangular in shape, having a length of thirty eight inches and a width of thirty five inches. Back panel 20, on its front surface 21, is provided with a pair of cooperating handle members 18 and 18' in which, when the cape is folded into a utility bag, are spaced in parallel for convenient grasping, as will hereinafter become more apparent. The handles are preferably constructed of a flexible material of high strength such as nylon or heavy vinyl. First handle 18 is attached by stitching or otherwise to the top central front surface of the back panel in an inverted position to leave the cradle portion of the "U" free for grasping. Similarly, handle 18' is attached to the bottom central front surface of the back panel in an upright position. A pair of parallel, vertically extending reinforcement strips 15 and 16, disposed between the handles, may be provided to give additional support to the structure when used as a bag. Strips 15 and 16 may be constructed of nylon webbing.

Front panels 25 and 29 are each rectangular in shape having a length equal to the back panel and having substantially one-half the width of the back panel. They may be constructed of the same material as the back panel and are each attached to the back panel along opposing vertical edges and the top, as shown in FIGS. 1 and 2. The front panels may be attached by stitching or may be integral with the back panel. Each of the front panels is provided with a collar recess portion 28 adjacent the top of the terminal free edge of each panel. The recesses combine, upon closing of the cape, to define a substantially circular or ovoid collar opening.

Each of the front panels may be provided along their free vertical edge with one or more snap fasteners 7 operable to fastly engage a respective and cooperative snap fastener 8. A front zipper or hook and eyelets may similarly be used, if desired. The front panels may also each be provided with a pocket, first pocket 35 and second pocket 39, which is secured to the interior surface of respective panels.

Figure 3:
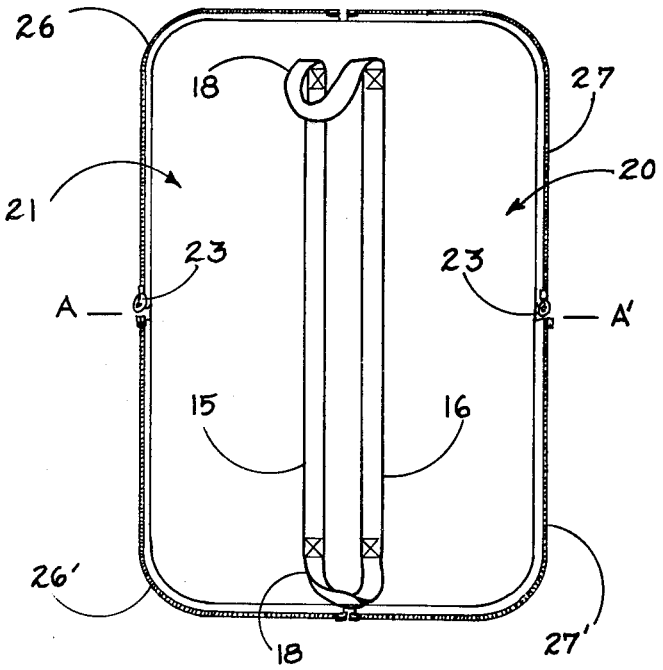
FIG. 3 is a rear view of the cape shown reversed.
Figure 4:
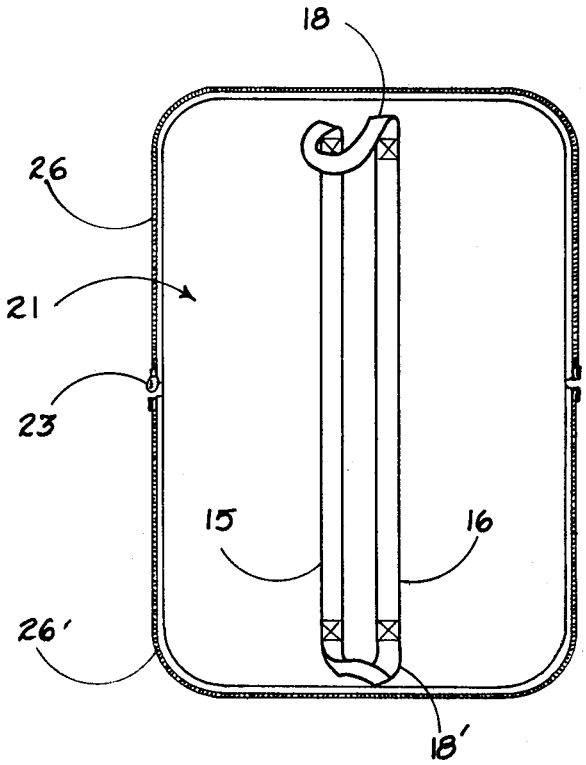
FIG. 4 is a rear view of the cape as reversed showing an alternate zipper arrangement.
Figure 5:
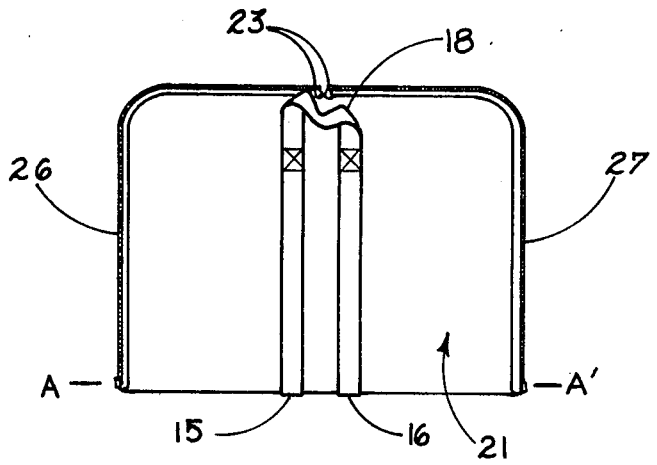
FIG. 5 is a side elevation of the bag.
Figure 6:
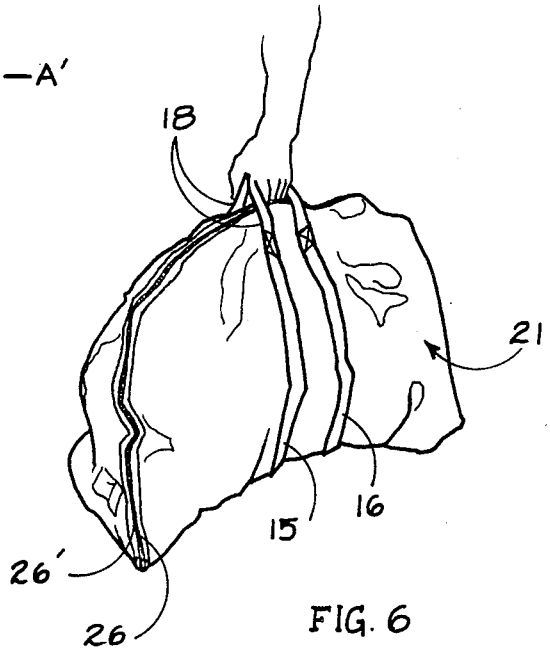
FIG. 6 is a perspective view illustrating the invention as a utility bag.

Referring now to FIGS. 3 and 4, two different embodiments of the fastening members of the present invention, which allow conversion of the cape to a utility bag, are disclosed. The first embodiment, shown to advantage in FIG. 3, permits construction of a bag which may be opened and closed by zipping the bag from each side to a top mid-point, as shown in FIGS. 5 and 6. On the front surface 21 of back panel 20 and adjacent the interior juncture of the back panel to the first front panel 25 is a first zipper portion 26. Portion 26 extends from substantially the midpoint of the vertical edge of the back panel to the approximate horizontal midpoint of the top edge. Similarly, a second zipper portion 27 extends along the back panel adjacent the interior juncture of the back panel to second front panel 29. Also, on the front surface 21 of back panel 20 and adjacent the interior juncture of the back panel to first front panel 25 is a first cooperating zipper portion 26'. Cooperating portion 26' extends from the approximate midpoint of the vertical edge of the back panel to the approximate horizontal midpoint of the bottom edge of the back panel. Similarly, a second cooperating zipper portion 27' extends along the back panel adjacent the interior juncture of the back panel to the second front panel 29.

It will be seen then, that as cape-bag combination 10 is folded inwardly along lines A—A, the vertical midpoint of the combination, with front surface 21 of back panel 20 outwardly facing, portions 26 and 26' and portions 27 and 27', respectively, are so oriented as to be in a spaced parallel relationship, as may be seen to advantage in FIG. 5. Zipper portions 26 and 26' and 27 and 27', respectively, may then be zipped together from the bottom of the bag to the midpoint top of the bag by moving the slider portion 23 of the zipper along the zipper portions in conventional manner. It is obvious that the zipper portions and cooperating zipper portions could be attached to the interior of the front panels or at a line on the juncture itself, it only being necessary that the zippers follow adjacent the juncture between panels. It is also to be understood that snap fasteners, hook and eyelet fasteners, draw strings, and the like might be substituted for the zippers of the preferred embodiment.

Referring now to FIG. 4, it will be seen, that zipper portions 26 and 27 and cooperating zipper portions 26' and 27' may be united to form a single zipper portion, designated by the numeral 26, and a single cooperating portion 26'. With the cape-bag 10 folded in the position shown in FIG. 5, it will then be seen that by zipping the portions together from the bottom of the bag, up one side, across the top, and down the other side to an opposing bottom position that a simplified fastening means is formed.

Figure 7:
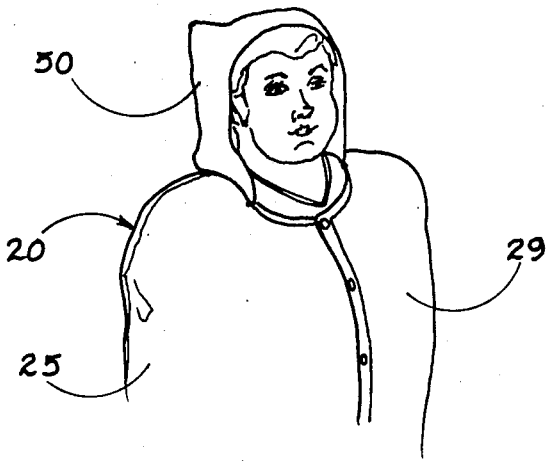
FIG. 7 is a perspective view of the hood as attached to the cape.

As shown in FIG. 7, a hood member 50 may also be provided. Hood 50 is conventional in construction and may be attached either permanently to the back panel, as by stitching, or may be temporarily attached by means of snap fasteners or zippers, not shown. In folding the cape into a bag, the hood portion may be simply folded inwardly flush with the front panels.

Figure 8:
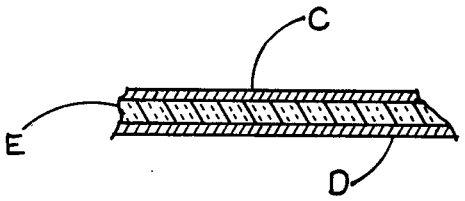
FIG. 8 is a sectional view of one embodiment of the cape.

While the back panels, front panels and hood may be constructed of a single flexible sheet of material, preferably water repellant, it may be desirable in colder climates to increase the insulative quality of the cape. This may be done by constructing the cape of two adjoining fabric layers of water repellant materials, or, as shown in FIG. 8, with two outer water repellant layers C and D, between which is sandwiched an insulative material E, such as Dacron. A wide variety of materials are currently available, both for construction of the outer layers and the insulative layer, and any suitable material may be used.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A combination cape and utility bag comprising:

means forming a substantially rectangular back panel, said back panel including a first handle member secured adjacent the top central surface thereof, and a second cooperating handle member secured adjacent the bottom central surface thereof;

means forming a first front panel and having a collar opening, said first front panel permanently joined to said back panel along one vertical edge and the top thereof;

means forming a second front panel having a collar opening mateable with the collar opening of said first front panel to define a substantially circular collar opening, said second front panel permanently joined to said back panel along an opposing vertical edge and top, whereby a cape is formed;

releaseable fastening means extending along the top peripheral edge of said back panel from substantially the vertical midpoint of one edge to substantially the vertical midpoint of the opposing edge; and a cooperating fastening means extending along the bottom peripheral edge of said back panel from substantially the vertical midpoint of one edge to substantially the vertical midpoint of the opposing edge to define a utility bag when fastened to said releaseable fastening means.

2. The combination as described in claim 1 further comprising a hood member attachable to said back panel adjacent said collar opening.

3. The combination as described in claim 1 further comprising at least one releasable fastening member secured to said first front panel adjacent its innermost terminal free edge and at least one cooperating fastening member secured to said second front panel adjacent its innermost terminal free edge, said releaseable fastening member operable to mate with said cooperating fastening member for opening and closing the cape.

4. The combination as described in claim 1 wherein each of said back and front panels is formed of at least two water repellant fabric layers in overlaying contact with one another.

5. A combination cape and utility bag comprising:

means forming a substantially rectangular back panel having a front surface and a back surface, said back panel including a first handle member secured adjacent the top central surface thereof, and a second cooperating handle member secured adjacent the bottom central surface thereof;

means forming a substantially rectangular first front panel having a front surface and a back surface, the back surface including a first pocket member, and said first front panel defining a collar opening, and said front panel permanently joined to said back panel along one vertical edge and the top thereof;

means forming a substantially rectangular second front panel having a front surface and a back surface, the back surface including a second pocket member, and said second front panel defining a collar opening mateable with the collar opening of said first front panel defining a substantially circular collar opening, and said second front panel permanently joined to said back panel along the top and opposing vertical edge thereof, whereby a cape having an interior and exterior surface is formed;

a first zipper portion extending along one interior side of said cape adjacent the juncture of said back panel with said first front panel from substantially the vertical midpoint of said side to said collar opening, and a second zipper portion extending along the opposing interior side of said cape in like manner, and a first cooperating zipper portion extending along the same interior side of said cape as said first zipper portion from substantially the vertical midpoint of said side to substantially the horizontal midpoint of the bottom of said back panel, and a second cooperating zipper portion extending along the opposing interior side of the cape and bottom of said back panel in like manner, said first and second portions engaging respective said first and second cooperating zipper portions, respectively, to define a top-opening utility bag.

6. The combination as described in claim 5 further comprising at least one releaseable fastening member secured to said first front panel adjacent its innermost terminal free edge and at least one cooperating fastening member secured to said second front panel adjacent its innermost terminal free edge, said releaseable fastening member operable to engage said cooperating member for securing said cape in a closed position.

7. The combination as described in claim 5 further comprising a hood member attachable to said back panel adjacent said collar opening.

8. The combination as described in claim 5 further comprising at least one reinforcement member, vertically disposed on the surface of said back panel between said handle members.

9. The combination as described in claim 5 wherein said back panel and each of said front panels is formed of at least two water repellent fabric layers in overlaying contact one with the other.

10. The combination as described in claim 9 wherein said back panel and each of said front panels further includes at least one layer of insulative material disposed between said water repellent fabric layers.

* * * * *